US005685730A

United States Patent [19]

Cameron et al.

[11] Patent Number: 5,685,730

[45] Date of Patent: Nov. 11, 1997

[54] POWER CONNECTOR SET WITH SECONDARY LOCK

[75] Inventors: John Cameron, Fife; Walter Mercer Chalmers, Dundee, both of Great Britain

[73] Assignee: Litton Precision Products International, Inc., Glenrothes, Scotland

[21] Appl. No.: 616,298

[22] Filed: Mar. 15, 1996

[51] Int. Cl.[6] ..... H01R 4/50

[52] U.S. Cl. ..... 439/335

[58] Field of Search ..... 439/332, 333, 439/335, 337, 338

[56] References Cited

U.S. PATENT DOCUMENTS 3,184,703 5/1965 Piscitello et al. ..... 439/335

3,500,291 3/1970 Hubbell et al. ..... 439/333 X 3,971,933 7/1976 Adamson, Jr. ..... 439/333 X 5,423,692 6/1995 Francis ..... 439/335

*Primary Examiner*—Khiem Nguyen

*Attorney, Agent, or Firm*—Michael H. Wallach

[57] ABSTRACT

A power connector, comprising first and second connector portions for connection to respective power conductors, a bayonet locking mechanism for locking the connector portions upon rotation of the first and second connector portions in a first direction relative to each other and unlocking the connector portions upon rotation of the first and second connector portions in an opposite direction relative to each other, and a secondary locking mechanism for preventing rotation of the first and second connector portions in the opposite direction relative to each other, thereby preventing accidental disconnection of the first and second connector portions.

4 Claims, 4 Drawing Sheets

POWER CONNECTOR SET WITH SECONDARY LOCK

FIELD OF THE INVENTION

This invention relates in general to electrical power connectors, and more particularly to a power connector set having a secondary lock for positively retaining both members of the set together against accidental disconnection.

BACKGROUND OF THE INVENTION

A "bayonet lock" connector is one in which two halves of the connector are coupled into connecting engagement by pushing them straight together, then locking them by means of a rotating action of less than one revolution. A description of such a prior art bayonet lock may be found in U.S. Pat. No. 5,423,692 (Francis) the teachings of which are incorporated herein by reference. The rotating action as described in the aforementioned patent, locks the connectors in engagement. In some prior art designs the rotating action is applied to a locking ring or nut, whereas in other prior art designs the entire connector is rotated.

Prior art bayonet lock connectors are designed for ease of use. It is a feature of such prior art designs that they can easily be coupled and uncoupled by one person. When a pair of engaged connectors is located in a place which is accessible to the public, unauthorized disconnection is possible. It can readily be envisioned that such unauthorized disconnection of operating equipment in use is undesirable and can be dangerous, especially if the connector is carrying high currents or high voltages. A person skilled in the art will also appreciate that if the connector is carrying a high current, the breaking of the circuit would cause an arc which could be life-threatening.

An object of an aspect of the invention is to prevent unlocking of the connectors by preventing rotation of the connectors relative to each other without the use of an appropriate tool.

In the case of a connector such as described in U.S. Pat. No. 5,432,692 in which the entire connector is rotated, and where, because the connector carries a high current, the connector is attached to a cable which is heavy and stiff. Consequently, it is possible for a twisting action applied to the cable inadvertently while it is being handled to rotate the connector and thus unlock it. Therefore, it is also an object of an aspect of the invention to "secondary lock" the connector to prevent it from being inadvertently unlocked by twist in the cable.

SUMMARY OF THE INVENTION

Therefore, in accordance with an aspect of the present invention, there is provided a power connector, comprising:

a) first and second connector portions for connection to respective power conductors;

b) a bayonet locking mechanism for locking said connector portions upon rotation of said first and second connector portions in a first direction relative to each other and unlocking said connector portions upon rotation of said first and second connector portions in an opposite direction relative to each other; and c) a secondary locking mechanism for preventing rotation of said first and second connector portions in said opposite direction relative to each other, thereby preventing accidental disconnection of said first and second connector portions.

BRIEF DESCRIPTION OF THE DRAWINGS

A detailed description of the preferred embodiment is provided herein below, in which.

DESCRIPTION OF THE PREFERRED EMBODIMENT

Figure 1:
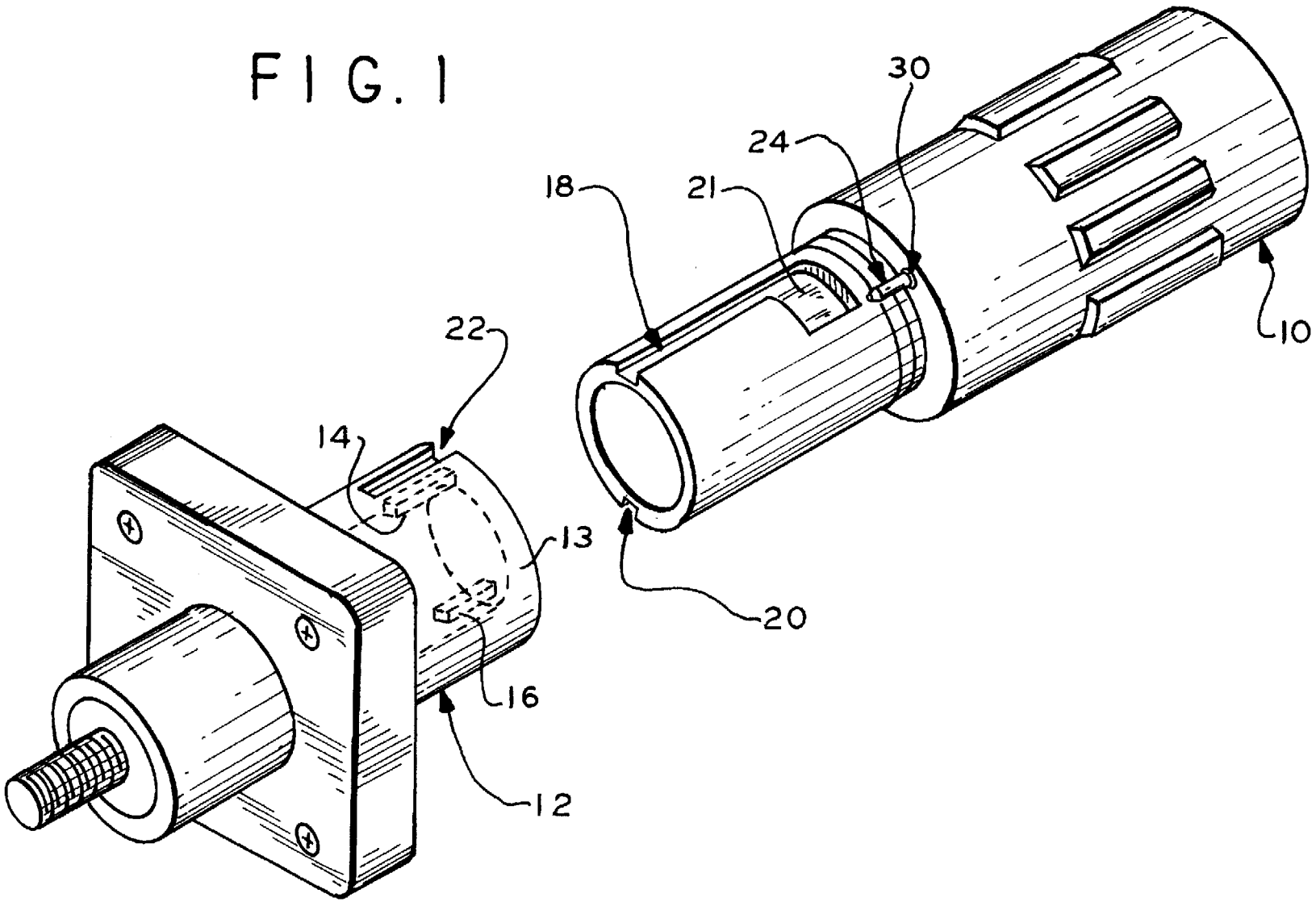
FIG. 1 is an isometric view of a connector similar to that of U.S. Pat. No. 5,423,692, having in addition, a secondary locking device in accordance with the present invention.
Figure 2:
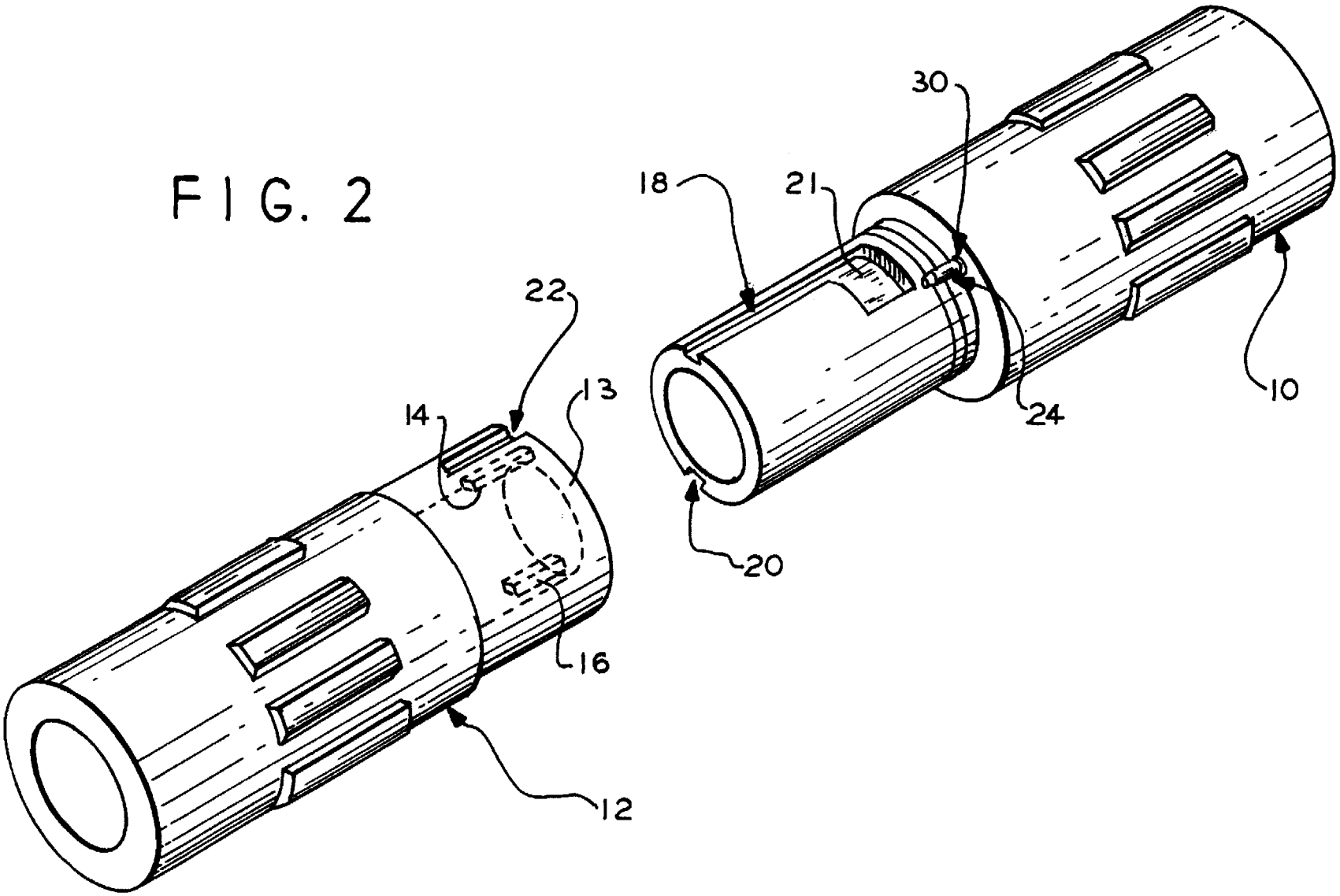
FIG. 2 is an isometric view of a connector similar to that of U.S. Pat. No. 5,423,692, but which is constructed to connect one cable to another cable, and which includes a secondary locking device in accordance with the present invention.

Referring to FIG. 1 and FIG. 2, a connector similar to that of U.S. Pat. No. 5,423,692 is shown comprising a plug 10 and a receptacle 12. The plug and receptacle are brought into contacting engagement by pushing them together in a manner which will be obvious to one skilled in the art. When pushed together, two keys 14 and 16 inside the insulator of the receptacle 12 engage two L-shaped slots 18 and 20 in the insulator of the plug 10 and slide within the slots until the L-shaped portion 21 is reached. The connectors are then rotated so that the keys enter the L-shaped portion 21. The connector is then locked such that a straight pull cannot disengage it. There are similar keys and slots (not shown) in the contacting elements integrally of the insulators which add to the strength and security of the arrangement.

Figure 3:
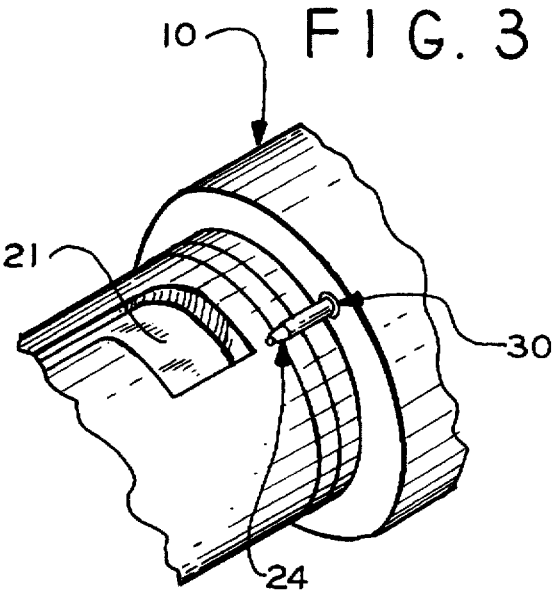
FIG. 3 is an enlarged isometric view of the active part of the secondary locking device shown fitted to the plug half of the connector in this embodiment.
Figure 4:
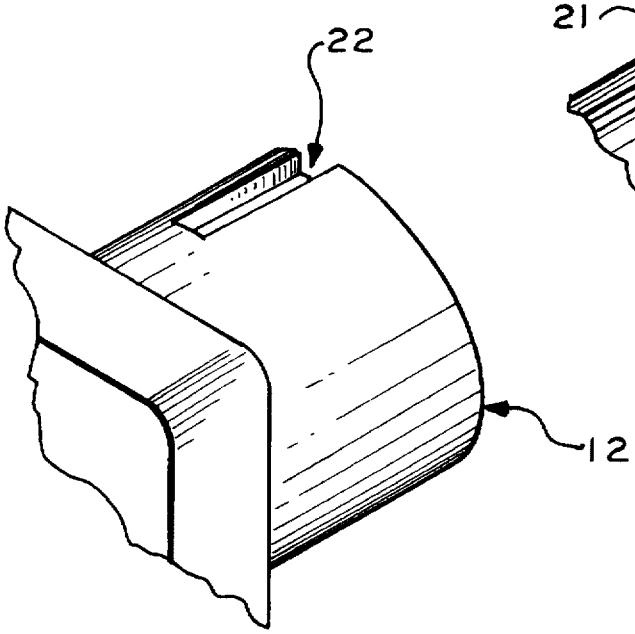
FIG. 4 is an enlarged isometric view of the passive part of the secondary locking device, shown fitted to the receptacle half of the connector in this embodiment.

A secondary locking device according to the present invention is provided to prevent the connector from being rotated in the reverse direction to the position where it can be disengaged by pulling or unintentional twisting of the plug and receptacle unless an appropriate tool is used to unlock this secondary locking device. The device comprises a passive part which, in the preferred embodiment, is in the form of a slot 22 in the insulation of the receptacle 12, as shown in FIGS. 1, 2 and 4, and an active part which, in the preferred embodiment, is in the form of a pin 24 in the insulator of plug 10 as shown in FIGS. 1, 2 and 3. The pin 24 is biased into the outward position shown by spring 26, as illustrated in FIG. 5.

When the plug 10 and receptacle 12 are slid into engagement, the face 13 of receptacle 12 presses against the pin 24 and pushes it back into the plug 10, thereby deflecting the spring 26. When the plug and receptacle are mutually rotated, the front of the pin 24 slides on the front face 13 of the receptacle until it reaches the slot 22. The pin 24 is then no longer restrained by the face of the receptacle 12 and is propelled by the spring 26 to its original position. The pin 24 is thus engaged in the slot 22 and prevents the plug and receptacle from being mutually rotated. They are thus constrained in the locked position.

Figure 5:
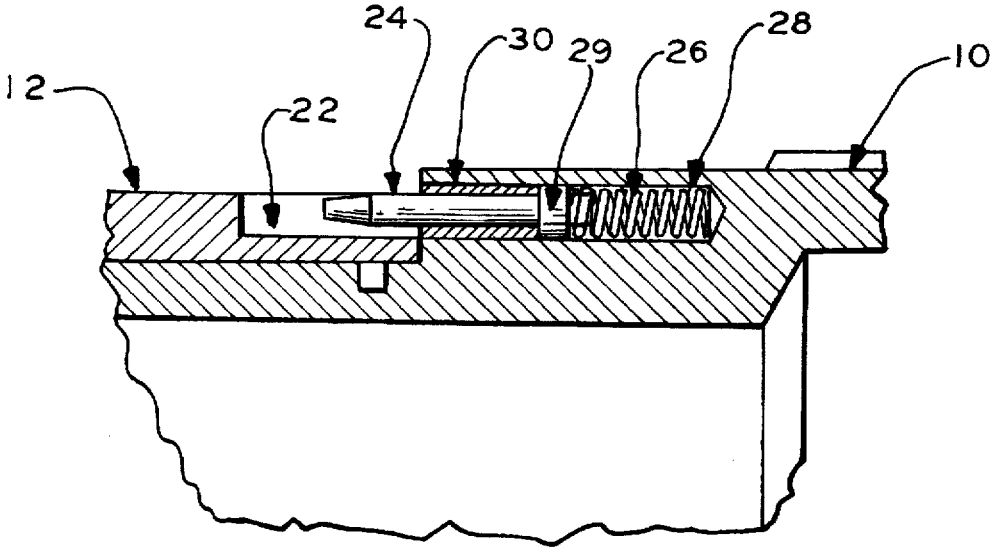
FIG. 5 is an enlarged cross-section through the secondary locking device, shown in the locked position.

FIG. 5 shows the pin 24 and the slot 22 in locking engagement, and illustrates one method by which the pin and spring may be fitted to one half of a connector. A hole 28 is made in the insulator of one half, shown in FIG. 5 as the plug half 10. The spring 26 is inserted into the hole 28, and the width of spring 26 is chosen such that the spring exhibits an easy sliding fit in the hole. The pin 24 is inserted into the hole after the spring. The pin has an enlarged portion 29 which is large enough to compress the spring but also exhibits an easy sliding fit in the hole. A collar 30 fits over the pin 24 which slides easily over the pin but is secured in a fixed relationship, for example by friction fit, within the hole. The collar bears against the enlarged portion 29 of the pin 24 to prevent the pin and spring from coming out of the hole. The pin may thus slide within defined limits in the collar and is kept in its forward position by the spring unless the spring is deflected by pressing on the front of the pin, as discussed below with reference to FIGS. 6 and 7. The pin 24 is thus kept in a position which engages the slot 22 while the connector is engaged and locked, but is able to move into hole 28 to allow the connector to be engaged and disengaged.

Figure 6:
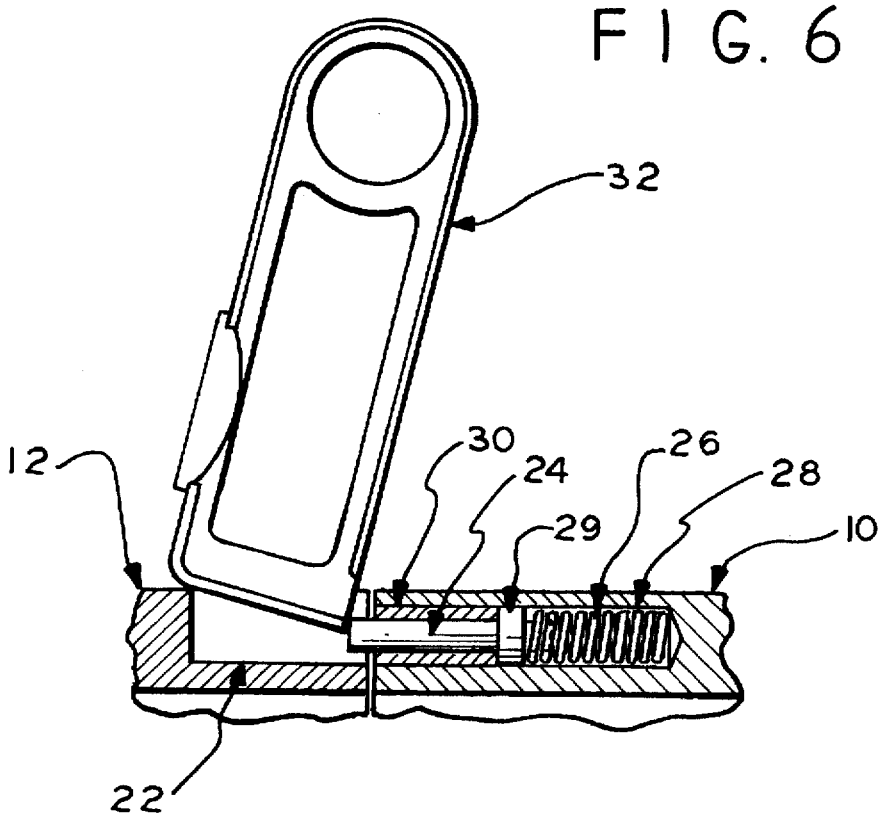
FIG. 6 and FIG. 7 show a suitable tool for unlocking the secondary locking device of the present invention.
Figure 7:
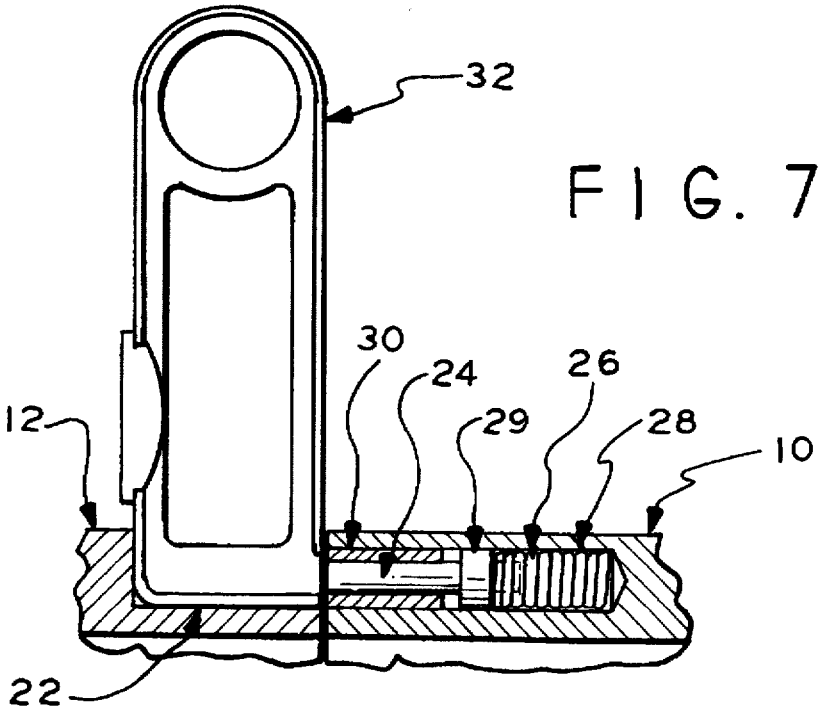

When it is desired and permitted to disengage the connector, a tool 32 may be used as shown in FIGS. 6 and 7. FIG. 6 shows the plug 10 and the receptacle 12 in engagement with the pin 24 in the slot 22 so as to prevent their unlocking. As shown, the tool 32 can be inserted into slot 22 to push pin 24 back into plug 10, thus unlocking the connector and allowing it to be rotated. FIG. 7 shows how, by making the tool 32 of a dimension to substantially exactly fit the slot, it can be retained in place by the pressure of the pin 24 with the connector unlocked, so that both of a user's hands are free to disengage one portion of the connector from the other. This is of particular advantage in the case of the cable-to-cable connector shown in FIG. 2.

A person understanding the present invention may conceive of other embodiments or variations therein. For example, the active part and the passive part of the secondary lock can be reversed from the plug-to-socket form of orientation shown in the drawings, to a socket-to-plug orientation. The hole 28 containing the active part can be drilled from the opposite direction. The spring 26 for pushing the pin 24 into position, can be a leaf spring or other suitable type of spring. Also, the pin 24 can be of another suitable shape other than cylindrical. All such embodiments and variations are believed to be within the sphere and scope of the invention as defined by the claims appended hereto.

We claim:

1. A power connector, comprising:

(a) first and second connector portions for connection to respective power conductors;

(b) a bayonet locking mechanism for locking said connector portions upon rotation of said first and second connector portions in a first direction relative to each other and unlocking said connector portions upon rotation of said first and second connector portions in an opposite direction relative to each other; and (c) a secondary locking mechanism for preventing rotation of said first and second connector portions in said opposite direction relative to each other, thereby preventing accidental disconnection of said first and second connector portions, said secondary locking mechanism being comprised of a slot disposed in said first connector portion, a pin disposed in said second connector portion, and a spring connected to said pin for urging said pin into said slot when said first and second connector portions are locked via said bayonet locking mechanism, said secondary locking mechanism requiring the insertion of a tool into said slot for retraction of said pin out of said slot to permit rotation of said first and said second connector portions for unlocking of said first connector portion from said second connector portion.

2. The power connector of claim 1, wherein said pin and spring are disposed within a hole in said second connector portion, said pin has an enlarged portion at one end being of sufficient dimensions to compress said spring while sliding freely within said hole, and a collar is provided around said pin in secure relation to said hole so as to bear against said enlarged portion when said pin is urged into said slot, thereby preventing removal of said pin from said hole.

3. The power connector of claim 1, wherein said bayonet locking mechanism further comprises at least one key disposed in said first connector portion and at least one L-shaped slot disposed in said second connector portion for receiving said at least one key via a first leg of said L-shaped slot, such that upon rotation of said first and second connector portions in said first direction relative to each other said at least one key enters a second leg of said L-shaped slot, said second leg being perpendicular to said first leg, thereby locking said connector portions.

4. The power connector of claim 1, wherein said tool is of a dimension to fit snugly within said slot for retention therein as a result of pressure of said pin thereagainst, thereby facilitating manual rotation of said first and second connector portions in said opposite direction relative to each other without holding said tool.

* * * * *